US008157054B1

(12) United States Patent
Adair

(10) Patent No.: US 8,157,054 B1
(45) Date of Patent: Apr. 17, 2012

(54) AQUATIC LADDER FOR MARINE APPLICATIONS

(76) Inventor: Michael Ray Adair, Dawsonville, GA (US)

( * ) Notice: Subject to any disclaimer, the term of this patent is extended or adjusted under 35 U.S.C. 154(b) by 491 days.

(21) Appl. No.: 12/335,528

(22) Filed: Dec. 15, 2008

Related U.S. Application Data

(63) Continuation-in-part of application No. 11/198,105, filed on Aug. 5, 2005, now Pat. No. 7,464,792, which is a continuation-in-part of application No. 10/836,180, filed on Apr. 30, 2004, now Pat. No. 7,090,049.

(51) Int. Cl.
*E06C 1/02* (2006.01)
*E06C 1/06* (2006.01)
*E06C 9/06* (2006.01)
*B63B 27/14* (2006.01)

(52) U.S. Cl. ..... 182/93; 182/97; 182/106; 182/194; 114/362

(58) Field of Classification Search ..... 114/343, 114/362, 364; D25/62–65; 182/21, 83–86, 182/93–99, 106, 127, 194, 206
See application file for complete search history.

(56) References Cited

U.S. PATENT DOCUMENTS 3,973,646 A * 8/1976 Martinez ..... 182/97
D243,953 S * 4/1977 Gannon ..... D25/64
5,333,323 A * 8/1994 Aymes ..... 4/496
D411,019 S * 6/1999 Curtis ..... D25/62
D499,190 S * 11/2004 Garelick et al. ..... D25/64
7,090,049 B2 * 8/2006 Adair ..... 182/97
7,464,792 B2 * 12/2008 Adair ..... 182/93
2005/0077106 A1 * 4/2005 Grundler ..... 182/97

* cited by examiner

*Primary Examiner* — Ajay Vasudeva
(74) *Attorney, Agent, or Firm* — Sanford J. Asman

(57) ABSTRACT

The aquatic ladder was designed for ease of use, rather than ease of storage. It has wide, deep treads, arranged like a staircase, with side and upper railings which make it easy to enter or exit the water, even by elderly people, tired individuals, those carrying aquatic equipment, such as SCUBA gear or water skis, and, even, by pets. In the preferred embodiment, the aquatic ladder includes upper railings which each have an inverted "U" shape, and the distal end of those railings have hinged brackets for mounting the aquatic ladder to an object to be boarded. In an alternative embodiment, the aquatic ladder is mounted on a sliding rail, such that it can be raised, vertically, from the water, when it is not being used. The vertical portions of the ladder are short, relative to the overall height of the ladder whereby less material is used to manufacture the ladder, while making its shipment and storage easier. The ladder is preferably made from aluminum, although it can be made of other materials, such as steel (e.g., stainless or galvanized), fiberglass, plastic, or other composites.

5 Claims, 4 Drawing Sheets

AQUATIC LADDER FOR MARINE APPLICATIONS

CROSS-REFERENCE TO RELATED APPLICATION(S)

The present application is a continuation-in-part of U.S. patent application Ser. No. 11/198,105, filed Aug. 5, 2005 entitled AQUATIC LADDER ADAPTED FOR MARINE APPLICATIONS, now U.S. Pat. No. 7,464,792 issued Dec. 16, 2008, which is a continuation-in-part of U.S. patent application Ser. No. 10/836,180, filed Apr. 30, 2004 entitled AQUATIC LADDER ADAPTED FOR MARINE APPLICATIONS, now U.S. Pat. No. 7,090,049 issued Aug. 15, 2006. The contents of the foregoing patents are incorporated herein by reference.

BACKGROUND OF THE INVENTION

The present invention relates to ladders used in marine applications. In particular, the invention relates to aquatic ladders used as boarding ladders on boats or to climb onto floating or fixed docks.

As used herein the term "aquatic ladder" is intended to mean those ladders which are specifically designed and intended for use while partially submerged. In the past, the primary objective addressed in the design of aquatic ladders has been ease of storage, rather than ease of use. Thus, many ladders designed for marine and aquatic applications (e.g., as boarding ladders on boats and ladders used to climb onto both fixed and floating docks) have been short (e.g., they had relatively few rungs extending into the water), or they have included features which allow them to be compact for storage and expanded for use (e.g., hinges for folding, sliding extensions, or sides made of chain or rope, so that they could be stored in a small volume). Most such aquatic ladders have also included rungs which are rather narrow, or round, making them even more uncomfortable and difficult to use. Due to their construction, the aquatic ladders of the prior art were also prone to considerable movement, as one tried to climb them, and they often lacked a secure handhold, particularly above the water level. While storage space is limited, and is, therefore, acknowledged to be a problem on boats, the consequence of making storage the primary objective in the design of an aquatic ladder is that the aquatic ladders heretofore known were difficult to use, and a challenge to ascend, particularly by pets (such as dogs), elderly persons, those carrying aquatic gear, such as SCUBA equipment or water skis, possibly some disabled persons, and even those in good physical shape who were simply tired from having engaged in aquatic activities without some assistance.

Further problems with the aquatic ladders previously known have involved the manner in which they attached to the boat or dock. In particular, since compact size has been the issue which was generally addressed, many ladders designed for aquatic use simply reached up to the lowest point possible, e.g., the surface of the dock or the gunwale (or swim platform) of the boat to be boarded. Further, they were typically placed immediately next to the object to which they were attached, meaning that they had very narrow steps, and that they were prone to swinging under such objects as they bore the weight of a person climbing them. Such designs have further increased the difficulty of their use.

While some of the aquatic ladders heretofore known have included design features which increase their usability, none have been found which truly address the issue of ease of use in a marine environment. By way of example, ladders heretofore known include those described in U.S. Pat. No. 6,378,654 entitled LADDER PIVOTALLY ATTACHED TO A GENERALLY VERTICALLY EXTENDING SURFACE which issued on Apr. 30, 2002 to Ziaylek, Jr., et al. which describes a ladder designed to be attached to a vehicle having a generally vertical wall. As shown in FIGS. 1-5, the ladder has a step supporting portion which slopes away from the vertical wall which supports substantially horizontal steps.

U.S. Pat. No. 5,896,946 entitled BOARDING LADDER AND WINCH MOUNT FOR BOAT TRAILERS AND THE LIKE which issued on Apr. 27, 1999 to W. E. Brackett describes a ladder having "steps" which enable easy access to a boat. However, while the ladder includes steps, and while it is adapted for use with a boat, it is intended to be integrated into a winch assembly on a boat trailer, and it is intended for use in accessing the boat while the boat is on a trailer, rather than for in-water use. Further, the disclosure of that patent distinguishes the ladder of the patent from a ladder which would provide in-water access in that it distinguishes the ladder of the patent from "boarding ladders" (See, Col. 1, lines 23-30) or aquatic ladders of the type described herein.

U.S. Pat. No. 5,339,919 entitled BOARDING LADDER ASSEMBLY HAVING A VARIABLE COUNTERWEIGHT LIFTING FORCE which issued on Aug. 23, 1994 to J. W. Boyd describes a boarding ladder assembly for mounting a boarding ladder in a manner which allows the boarding ladder to be lowered and raised. Again, the ladder is used on a vehicle, but it is not intended for a marine application in which the steps would be under water.

U.S. Pat. No. 4,724,925 entitled BOAT BOARDING LADDERS which issued on Feb. 16, 1988 to R. G. Ritten describes a boat boarding ladder having horizontal steps which are attached to a section which extends into the water at an angle from the vertical.

U.S. Pat. No. 4,719,989 entitled BOAT BOARDING LADDERS HAVING A STOWAGE FEATURE which issued on Jan. 19, 1988 to R. G. Ritten describes a boat boarding ladder having an upper inverted "U" shaped railing, but it does not have a vertical member, nor does it have hinges at the point of attachment.

U.S. Pat. No. 4,243,120 entitled RETRACTABLE BOARDING LADDER which issued on Jan. 6, 1981 to D. Pratt, Jr. describes a "boarding stairway" which has a stair supporting member which extends away from the vertical and which supports substantially horizontal steps. The entire assembly is adapted to be moved vertically, but it is not adapted for a marine application, nor does it include a vertical member which extends downward from the upper portion or an inverted "U" railing at its upper portion.

U.S. Pat. No. 4,186,820 entitled BOARDING LADDER AND STRAPS which issued on Feb. 5, 1980 to D. Cosman et al. describes a boarding ladder for use with an inflatable boat. The rungs are supported by a member which extends down and away from the boat. However, the ladder does not include the vertical member, the inverted "U" shaped rail, or the wide, horizontal steps of your invention.

U.S. Pat. No. D-411,049 entitled ROLLING STAIR which issued on Jun. 15, 1999 to C. G. Curtis illustrates a ladder-like apparatus having stair-like steps which attach to a vertical rear portion which extends downward to the lowest vertical step. Also, the rolling stairs, appear to include wheels which allow them to roll on surface.

U.S. Pat. No. D-243,953 entitled SAFETY LADDER FOR THE ABOVE GROUND POOL which issued on Apr. 5, 1977 to P. F. Gannon illustrates a ladder having two sets of steps. While this ladder appears to be intended for use in an above-ground pool, as shown in FIG. 3 thereof, the teaching is to place the vertically oriented rungs, rather than the step-like stairs into the water. Further, this ladder includes a rear vertical portion (shown in the water in FIG. 3) which extends downward to the lowest vertical step on the sloped portion.

U.S. Pat. No. 3,446,309 entitled ROLLER MOUNT FOR LADDERS which issued on May 27, 1969 to R. D. Davis et al. describes a way to mount casters on the bottoms of the legs of folding ladder.

U.S. Pat. No. 3,283,402 entitled METHODS FOR FABRICATING LIGHTWEIGHT METAL LADDER which issued on Nov. 8, 1966 to C. E. Larson describes methods for forming ladders with lightweight metal rungs.

SUMMARY OF THE INVENTION

Unlike the designs of the prior art, the present invention is an aquatic ladder whose design has both ease of use and ease of storage as its primary objectives. In order to accomplish that objective, the aquatic ladder of the present invention includes features which are intended to make it easy to use by persons, including elderly persons, those tired from having engaged in aquatic activities, some disabled persons, and those who might be carrying additional gear (e.g., SCUBA equipment or water skis). Further, the aquatic ladder of the present invention can be used by pets, as it provides both easy ingress into, and easy egress from, the water.

When not in use, the aquatic ladder of the present invention is readily stored, as it includes hinges which enable the lower portion which extends into the water to be folded up to lie adjacent to the upper portion.

In order to accomplish these design objectives, the aquatic ladder of the present invention includes a pair of substantially parallel, substantially vertical members which extend downward toward, or into, the water, and which preferably have an upper portion which contacts the hull or transom of the boat or side wall of the dock with which the aquatic ladder is being used. As used herein, the term "substantially vertical" is intended to mean that these members might not be vertical in a particular application, for example if the aquatic ladder is attached to the hull or transom of the boat which is not vertical, as it is preferred to have the substantially vertical support members lie proximate a wall of the item to be boarded (e.g., the boat or dock) in order to prevent relative movement between the aquatic ladder and the object to be boarded in order to increase the stability of the aquatic ladder. In accordance with the invention, the upper portions of the substantially vertical support members extend out of the water, and above the surface of the object to be boarded, and the upper portions include substantially inverted "U" shaped portions. These substantially inverted "U" shaped portions which extend up and over the surface of the dock, or the transom, swim platform, or gunwale of the boat, provide hand support rails which further ease use of the aquatic ladder of the present invention, particularly for those who are tired or who are unbalanced due to carrying such things as water skis or due to their having SCUBA gear on their back.

The aquatic ladder of the present invention further includes relatively deep, horizontal steps, rather than the thin, or round, rungs heretofore in general use. The rungs are preferably attached to sloped members which attach to the substantially vertical members adjacent the location where the substantially vertical members attach to the inverted "U" shaped rails.

While the main design objective of the ladders which are the subject of the parent applications of the present invention was to address ease of use, rather than ease of storage, it is recognized that the invention is intended for use in applications in which storage is of some concern. Accordingly, in the preferred embodiment, the aquatic ladder preferably includes a pair of hinges which are preferably located approximately midway up the legs which extend into the water whereby the distal ends of the upper railings can swing up and out of the water.

DETAILED DESCRIPTION OF THE EXEMPLARY EMBODIMENTS

Figure 1:
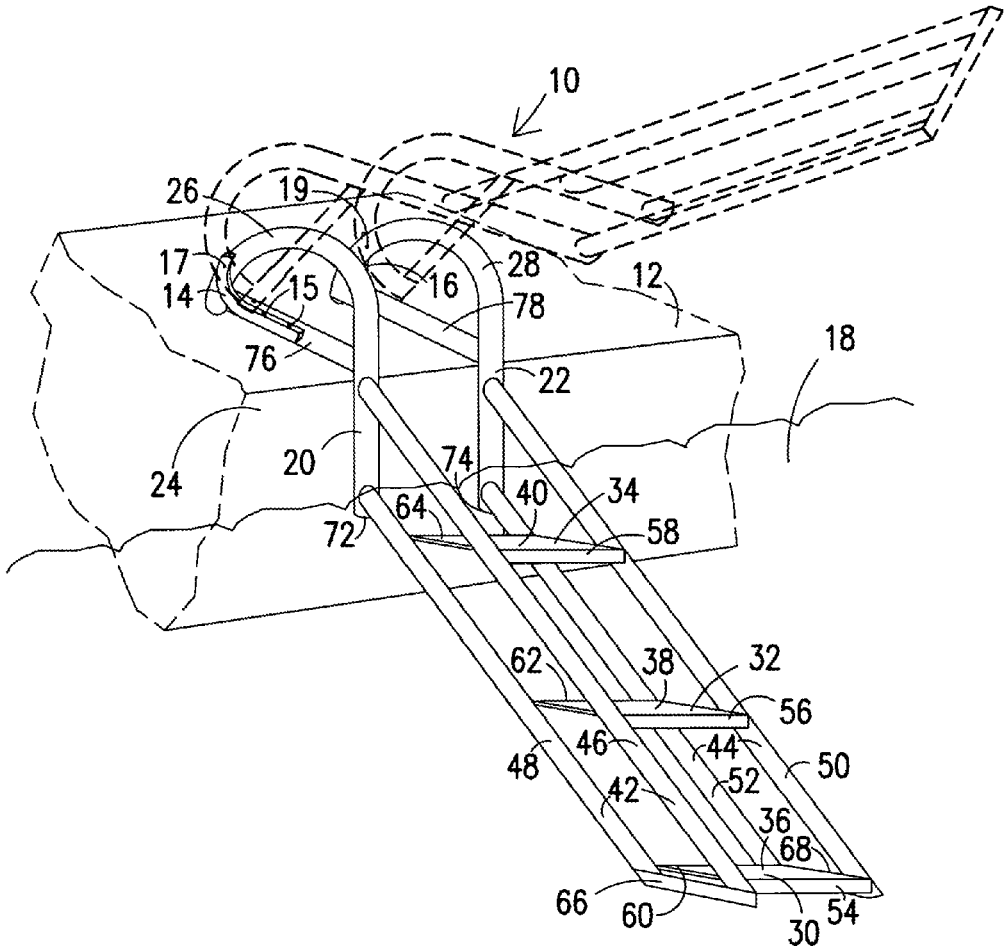
FIG. 1 is perspective view of the ladder of the present invention.
Figure 2:
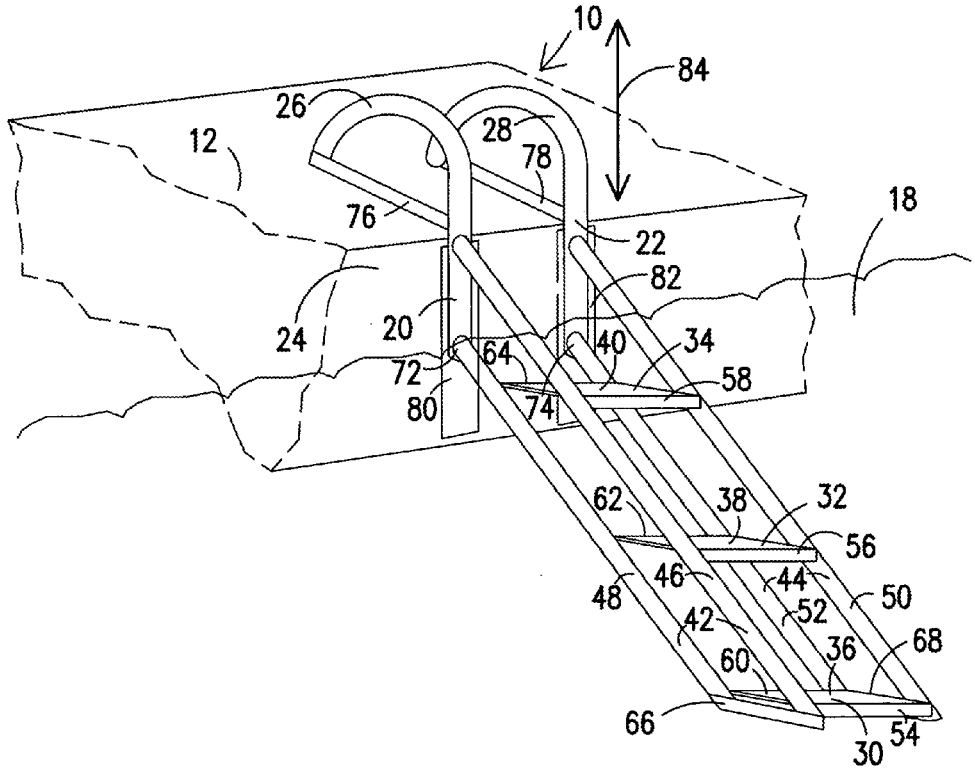
FIG. 2 is a perspective view of an alternative embodiment of the aquatic ladder of the present invention.

FIG. 1 is a perspective view of the preferred embodiment of the aquatic ladder 10 of the present invention, which is intended to be used in marine applications. The aquatic ladder 10 is shown attached to a dock 12, using a pair of hinged brackets 14, 16. The hinged brackets 14, 16 are preferably attached to the dock 12 using bolts 15. The brackets 14, 16 are attached to the aquatic ladder using bolts 17, 19 which are set up high enough so as to allow the aquatic ladder 10 to be swung up and out of the water 18, and onto the dock 12 when not in use. The aquatic ladder 10 is comprised of a pair of substantially parallel, substantially vertical support members 20, 22 which are spaced from one another, and which are designed to hang down toward, or into, the water 18 adjacent the side 24 of the dock 12. The hinged brackets 14, 16 are attached to upper railings 26, 28, respectively, each of which is preferably in the shape of an inverted "U" so as to function as a hand railing.

The aquatic ladder 10 further comprises a series of steps 30, 32, 34 which are arranged in a staircase manner, with each of the steps 30, 32, 34 having relatively deep (i.e., front to rear) horizontal treads 36, 38, 40, which are about 8 to 10 inches deep in the preferred embodiment of the invention. The steps 30, 32, 34 are preferably fairly wide (e.g., about 16 inches wide in the preferred embodiment of the invention), and they preferably have about a 10 to 12 inch vertical rise between steps 30, 32, 34. As used in the preferred embodiment of the invention, the treads 36, 38, 40 can include a patterned or perforated surface, so as to make them less slippery. Diamond patterned aluminum is used in the aquatic ladder 10 of the preferred embodiment. The steps 30, 32, 34 each extend between a pair of spaced sloped step support members 42, 44, which are comprised, respectively, in the preferred embodiment of the invention, of pairs of front and rear supports 46, 48 and 50, 52, although those skilled in the art will recognize that it would be possible to have a single sloped step support member on either side of the steps 30, 32, 34, without departing from the invention. The deep treads 36, 38, 40 of the present invention provide flat steps for use by persons or pets using the aquatic ladder 10. With continued reference to FIG. 1, the steps 30, 32, 34 each have a front edge 54, 56, 58, and a rear edge 60, 62, 64, as shown. In the preferred embodiment shown, the portions of the steps 30, 32, 34 proximate their front edges 54, 56, 58 are affixed, by bolting or welding, to the front supports 46, 50, while the portions of the steps 30, 32, 34, proximate their rear edges 60, 62, 64, are affixed to the rear supports 48, 52, of the sloped step support members 42, 44.

In the preferred embodiment of the invention, the aquatic ladder 10 further includes a pair of lower horizontal supports 66, 68, which connect the sloped front and rear supports 46, 48, 50, 52 of the lower portions of the support members 42, 44, respectively. A pair of upper horizontal supports 76, 78 extends between the upper portions of the substantially vertical support members 20, 22 and the distal ends of the upper railings 26, 28.

In the preferred embodiment of the invention, the vertical support members 20, 22 are relatively short, extending downward toward, or into, the water 18, but not extending downward as far as the lower step 30, as the vertical members 20, 22 need only be long enough to connect to the upper ends 72, 74 of the rear step supports 48, 52, as they do not need to otherwise support the aquatic ladder 10, as they would if the ladder was intended for non-aquatic uses (as in U.S. Pat. No. D-411,019 issued to C. G. Curtis on Jun. 15, 1999; or as in U.S. Pat. No. D-243,953 issued to P. F. Gannon on Apr. 5, 1977). By keeping the vertical members 20, 22 short relative to the overall vertical height of the aquatic ladder 10, e.g., relative to the vertical difference between the lowest step 30 and the tops of the upper railings 26, 28, the overall weight and size of the aquatic ladder 10 is reduced, thereby requiring less material to manufacture the ladder, while making it more compact and lighter for shipping and storage purposes.

Figure 3:
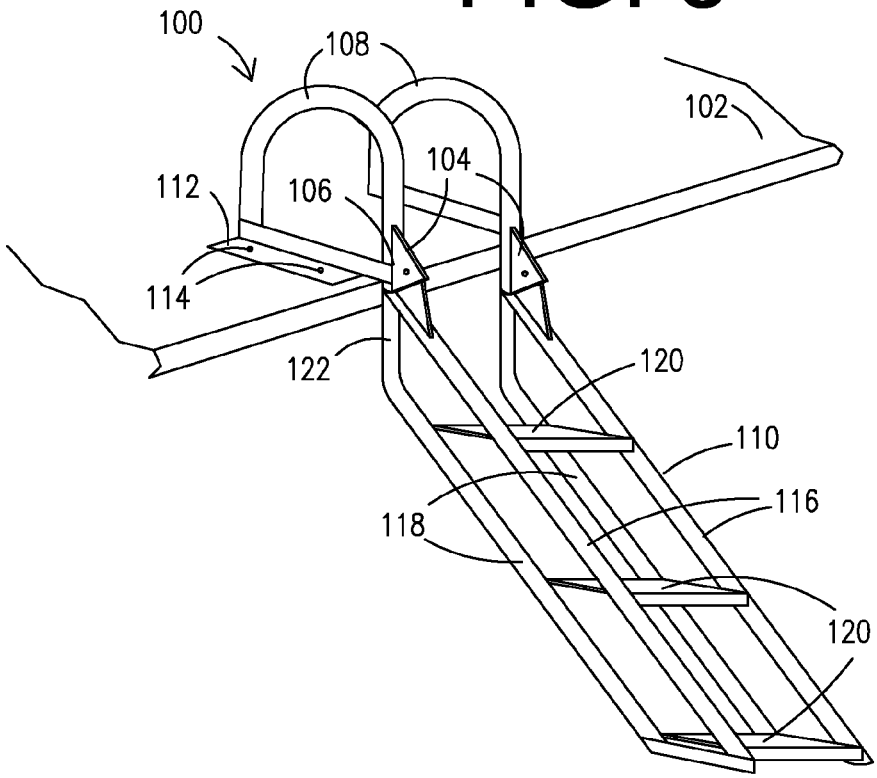
FIG. 3 is perspective view of the ladder of the aquatic ladder of the present invention adapted for use on a boat having a swim platform, showing the ladder in position for use.
Figure 4:
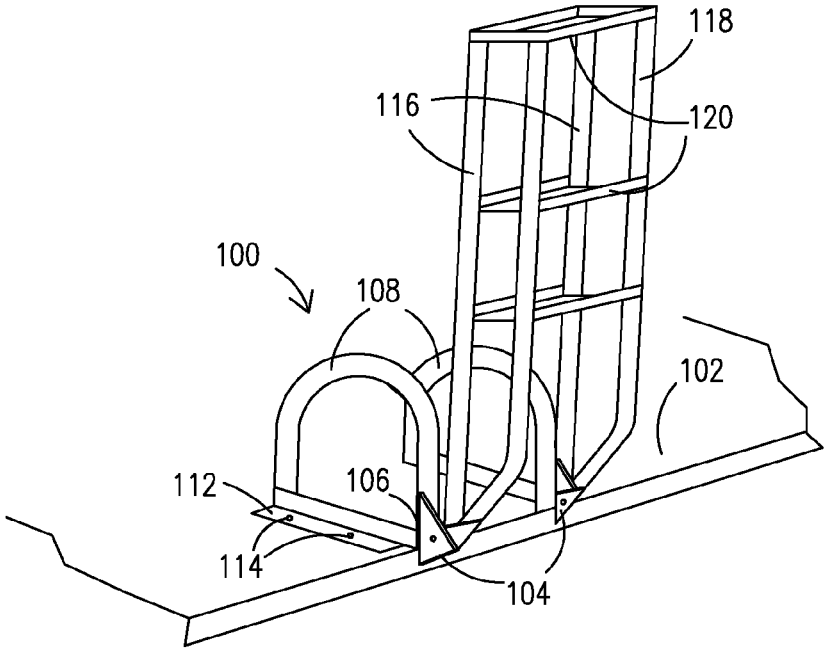
FIG. 4 is a perspective view of the aquatic ladder of the present invention of FIG. 3, showing the ladder in its stored position.
Figure 6:
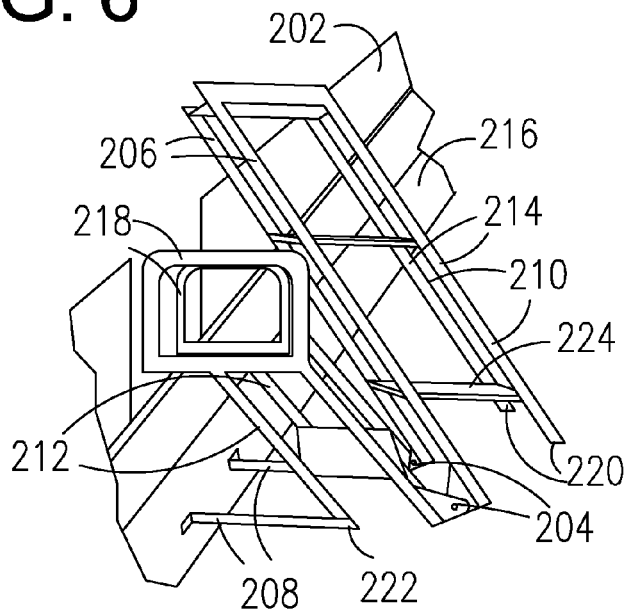
FIG. 6 is a perspective view of the aquatic ladder of the present invention of FIG. 5, showing the ladder in its stored position.

Referring now to FIGS. 3 and 4, an embodiment 100 of the aquatic ladder specifically adapted for use on a swim platform 102 of a boat having a swim platform, such as a cruiser or a houseboat, is shown. The ladder 100 differs from those previously described in that it includes a pair of hinges 104 at the distal ends 106 of the U-shaped handrails 108 which enable the lower portion 110 of the ladder 100 to be swung up, out of the water, as shown in FIG. 6, or swung down, into the water, as shown in FIG. 3. Further, the ladder 100 includes attachment means, such as flange 112, which enable the handrails 108 to be securely affixed to the swim platform 102, using bolts 114. The ladder 100 includes a pair of substantially parallel sloped step support members, with each pair including a front sloped member 116 and a rear sloped member 118, which allow substantially horizontal steps 120 to be affixed therebetween. In the present embodiment, the upper portions 122 of the rear sloped members 118 are curved or bent, whereby they meet and connect to the upper portions of the front sloped members 116 at the hinges 104. Thus, when the ladder 100 is in the stowed position shown in FIG. 4, the lower portion 110 is entirely out of the water, and in a substantially vertical orientation, as shown, whereby the lower portion 110 of the ladder 100 is out of the water, yet does not otherwise take up room on, or block, the swim platform 102.

Figure 5:
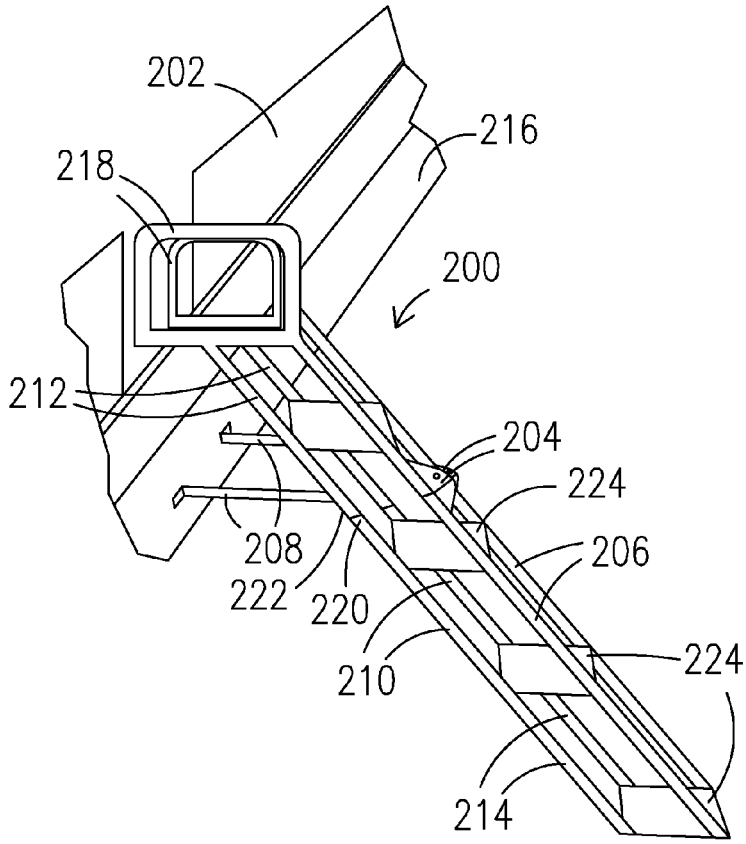
FIG. 5 is perspective view of the ladder of the aquatic ladder of the present invention adapted for use on a pontoon boat, showing the ladder in position for use.

Referring now to FIGS. 5 and 6, yet another embodiment 200 of the aquatic ladder specifically adapted for use on a pontoon boat 202, is shown. The ladder 200 differs from those previously described. The ladder 200 includes both a pair of hinges 204, which are located partway down the front sloped members 206 of the ladder 200, and a pair of standoffs 208. The ladder 200 includes a pair of substantially parallel sloped step support members, with each pair including a front member 206 and a rear member 210. The rear members 210 each include both upper portions 212 and lower portions 214. The upper portions 212 are attached to the standoffs 208, which attach them to a pontoon 216 of the pontoon boat 202, thereby allowing the ladder 200 to be folded on an angle toward the upper, inverted U-shaped handles 218, as shown in FIG. 6. When the ladder 20 is unfolded for use, the upper ends 220 of the lower portions 214 contact the lower ends 222 of the upper portions 212, as shown in FIG. 5. As in the other embodiments, relatively wide steps 224 extend between the front members 206 and the rear members 210.

The described features of the aquatic ladders 10, 100, 200 make entry into, or exit from, the water easy for both people and pets. The deep, flat, horizontal treads mounted on the sloped step support members make it easy to "walk" up the ladders while holding onto the front supports, until near the top, where the upper railings provide further hand grips while exiting the water, thereby making the aquatic ladders 10, 100, 200 much like stable staircases, rather than the challenge of the aquatic ladders heretofore known.

Pets, such as dogs, can easily get out of the water without having a person struggle with them while bent over a slippery swim platform or dock, even if they go into the water when no one is nearby to assist them.

Similarly, elderly people, and some disabled people who do not have the ability to climb the aquatic ladders of the prior art can use the aquatic ladder 10 of the present invention, as well. Whereas a person's natural buoyancy made using the swaying, unsecured aquatic ladders of the prior art a challenge, the buoyancy of their body actually assists the user of the aquatic ladder 10 of the present invention. In fact, due to the body's natural buoyancy, the aquatic ladder 10 of the present invention is even easier for someone to use than steps, and far less dangerous for elderly people than the aquatic ladders previously known. As compared to the swinging aquatic ladders heretofore known, which have a tendency to move under the dock or boat to which they are affixed, thereby causing the person to struggle with climbing while somewhat inverted, there is no comparison.

While the aquatic ladders 10, 100, 200 can be made of a variety of materials, bearing in mind that the ladder will be subject to a wet, and possibly salty environment, in the preferred embodiment the material used is solid, one piece aluminum. The steps in the ladder 10, 100, 200 of the preferred embodiments, are made of diamond plate aluminum and are rolled at their front edges to prevent cuts. The hinged mounting brackets allow the aquatic ladders 10, 100, 200 to be lifted out of the water 18 for storage, as shown in FIGS. 1, 6, and 8.

The aquatic ladders 10, 100, 200 can be manufactured in a number of ways, allowing flexibility in meeting consumer requirements and shipping considerations. More specifically, the aquatic ladders 10, 100, 200 can be welded as a single solid piece, or it can be broken down into component pieces requiring assembly, or as an assembly kit to attach to an existing ladder. As will be recognized by those skilled in the art, construction materials may include, but are not limited to aluminum, steel (including galvanized steel and stainless steel), fiberglass, plastics, or other composites.

As will be understood by those skilled in the art, while the aquatic ladders of the present invention have been described as having three steps, the actual number of such steps may be varied, and may be greater, or fewer, than three without departing from the invention as described herein.

I claim:

1. An aquatic ladder, comprising:

(a) a pair of sloped and substantially parallel step support members, said step support members each comprising a front support member and a rear support member, said front support member being spaced from said rear support member, wherein said front support members and said rear support members each includes upper and lower ends, the upper end of each rear support member having a bent portion which connects to the upper end of the respective one of said front support members of said step support members;

(b) a pair of handrails, each said handrail having an inverted U-shape with forward and rear lower ends, each of said forward lower ends being adapted to connect to a hinge;

(c) a pair of hinges pivotally connecting said upper ends of said front and rear support members to the forward lower ends of said handrails to allow said step support members to pivot about a substantially horizontal axis;

(d) a plurality of relatively deep and relatively wide substantially horizontal steps being mounted to said sloped support members, said horizontal steps each having front and rear ends, wherein said front support members are attached to the front ends of said horizontal steps and said rear support members are attached to the rear ends of said horizontal steps, and wherein each lower step of said horizontal steps is displaced both vertically and horizontally further from a location where one of said horizontal steps immediately above it is attached to said step support members.

2. The aquatic ladder of claim 1 wherein said front support members are formed of tubular material.

3. The aquatic ladder of claim 1 wherein said front support members are formed of aluminum.

4. The aquatic ladder of claim 1 wherein said handrails comprise attachment means for attaching said ladder to a floating platform or a boat.

5. The aquatic ladder of claim 4 wherein said attachment means comprises a flange.

* * * * *

US008157054C1

(12) EX PARTE REEXAMINATION CERTIFICATE (10424th)

United States Patent
Adair

(10) Number: US 8,157,054 C1
(45) Certificate Issued: Dec. 5, 2014

(54) AQUATIC LADDER FOR MARINE APPLICATIONS

(76) Inventor: Michael Ray Adair, Dawsonville, GA (US)

Reexamination Request:
No. 90/012,660, Sep. 14, 2012

Reexamination Certificate for:

| | |
|---|---|
| Patent No.: | **8,157,054** |
| Issued: | **Apr. 17, 2012** |
| Appl. No.: | **12/335,528** |
| Filed: | **Dec. 15, 2008** |

Related U.S. Application Data

(63) Continuation-in-part of application No. 11/198,105, filed on Aug. 5, 2005, now Pat. No. 7,464,792, which is a continuation-in-part of application No. 10/836,180, filed on Apr. 30, 2004, now Pat. No. 7,090,049.

(51) Int. Cl.

| | |
|---|---|
| ***E06C 1/02*** | (2006.01) |
| ***E06C 1/06*** | (2006.01) |
| ***E06C 9/06*** | (2006.01) |
| ***B63B 27/14*** | (2006.01) |

(52) U.S. Cl.
USPC ..... 182/93; 182/97; 182/106; 182/194; 114/362

(58) Field of Classification Search
None
See application file for complete search history.

(56) References Cited

To view the complete listing of prior art documents cited during the proceeding for Reexamination Control Number 90/012,660, please refer to the USPTO's public Patent Application Information Retrieval (PAIR) system under the Display References tab.

*Primary Examiner* — Jeffrey L. Gellner

(57) ABSTRACT

The aquatic ladder was designed for ease of use, rather than ease of storage. It has wide, deep treads, arranged like a staircase, with side and upper railings which make it easy to enter or exit the water, even by elderly people, tired individuals, those carrying aquatic equipment, such as SCUBA gear or water skis, and, even, by pets. In the preferred embodiment, the aquatic ladder includes upper railings which each have an inverted "U" shape, and the distal end of those railings have hinged brackets for mounting the aquatic ladder to an object to be boarded. In an alternative embodiment, the aquatic ladder is mounted on a sliding rail, such that it can be raised, vertically, from the water, when it is not being used. The vertical portions of the ladder are short, relative to the overall height of the ladder whereby less material is used to manufacture the ladder, while making its shipment and storage easier. The ladder is preferably made from aluminum, although it can be made of other materials, such as steel (e.g., stainless or galvanized), fiberglass, plastic, or other composites.

**Attention is directed to the decision of *Adair* v. *Boat Dock Innovatoins LLC et al.*, 1:12cv1930 (N.D. Ga. filed: 6/4/2012) relating to this patent. This reexamination may not have resolved all questions raised by this decision. See 37 CFR 1.552(c) for *ex parte* reexamination and 37 CFR 1.906(c) for *inter partes* reexamination.**

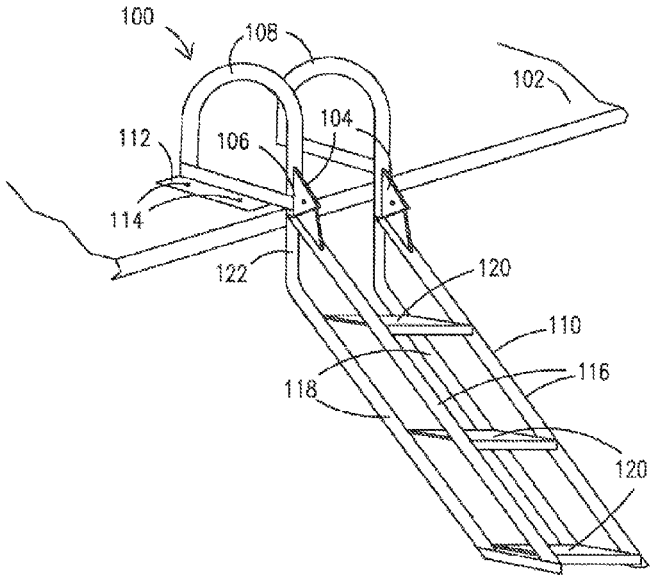

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-5 are cancelled.

* * * * *